United States Patent [19]

Lunau

[11] Patent Number: 4,805,248

[45] Date of Patent: Feb. 21, 1989

[54] INVALID TRANSFER LIFT

[76] Inventor: Kevin R. Lunau, 3286 Michaud Avenue, Mississauga, Ontario, Canada, L4T 1P7

[21] Appl. No.: 100,195

[22] Filed: Sep. 23, 1987

[51] Int. Cl.[4] ..... A61G 7/08

[52] U.S. Cl. ..... 5/81 R; 5/83; 5/89

[58] Field of Search ..... 5/81 R, 83, 84, 86, 5/89

[56] References Cited

U.S. PATENT DOCUMENTS

| | | | |
|---|---|---|---|
| 841,702 | 1/1907 | Martin | 5/89 |
| 3,234,568 | 2/1966 | Fischer | 5/89 |
| 3,351,959 | 11/1967 | Turpin | 5/83 |
| 3,999,228 | 12/1976 | Thomas | 5/86 |
| 4,627,119 | 12/1986 | Hachey et al. | 5/89 X |

FOREIGN PATENT DOCUMENTS

| | | | |
|---|---|---|---|
| 1094405 | 12/1967 | United Kingdom | 5/81 R |

*Primary Examiner*—Gary L. Smith
*Assistant Examiner*—Michael F. Trettel
*Attorney, Agent, or Firm*—Richard J. Hicks

[57] ABSTRACT

An apparatus for lifting an invalid from a wheelchair to a bed or vice versa, which can be operated by the invalid himself. A generally rectangular, vertical frame is arranged adjacent the invalids' chest. The frame carries a motorized winch drum, battery pack, gearbox and fingertip controls therefor. A six point suspension heavy canvas sling is designed to be mounted at the four respective corners of the frame, to provide a seat and back support for the invalid.

4 Claims, 3 Drawing Sheets

INVALID TRANSFER LIFT

FIELD OF INVENTION

This invention relates to an apparatus for lifting and transporting an invalid, and more particularly to a patient lift system which is operable by the patient and which includes a frame device which incorporates the lift controls, motor and power pack.

The apparatus is especially useful for bedridden patients who have some use of their motor facilities from the waist up as the device is designed to be operated and controlled by the patient, although it is also controllable by a nurse or other attendant.

BRIEF DESCRIPTION OF THE PRIOR ART

Patient lifting and transporting devices are, of course, well known in the art and generally fall into two main types: a crane on casters or an overhead permanently mounted hoist on a track. Attention is directed to U.S. Pat. No. 2,903,238 issued Sept. 5, 1959 to Flaudrich for an example of the first type, and to U.S. Pat. No. 4,125,908 issued Nov. 21, 1978 to Vail et al for an example of the second type. Attention is also drawn to U.S. Pat. Nos. 2,368,390 Winter 3,123,224 Kral 3,351,959 Turpin 3,999,228 Thomas and to Canadian Pat. Nos. 93,946 Storms 903,660 James 903,952 Whitaker 941,337 Bakker 969,138 Spivery 1,127,624 Kristensson, all of which relate to various forms of patient lifting device but which do not incorporate the elements and advantages of the present invention. All require either a cumbersome crane or gantry device or include relatively cumbersome and expensive motor devices. In addition, the prior art devices generally fail to provide a totally secure and comfortable sling to support the patient. There is, therefore, a considerable need for a simple and relatively inexpensive patient lifting device which is operable by the patient or by an attendent.

SUMMARY OF INVENTION

It is an object of the present invention to provide a simple, self-contained patient lifting device which is operable by the patient or by an attendant.

Thus, by one aspect of this invention there is provided a patient controllable motorized patient transfer lift for raising and lowering said patient comprising:

(a) a generally rectangular frame having lifting points at each of its four corners;

(b) motor means mounted on said frame;

(c) winch drum means mounted on said frame;

(d) gear means mounted on said frame and operatively disposed between said motor means and said winch drum means;

(e) means to activate said motor and gear means, mounted on said frame and accessible to said patient; and (f) a suspension harness having a plurality of attachment points arranged to be secured to respective ones of said lifting points so as to provide a seat and back support for said patient.

DETAILED DESCRIPTION OF THE PREFERRED EMBODIMENT

Figure 2:
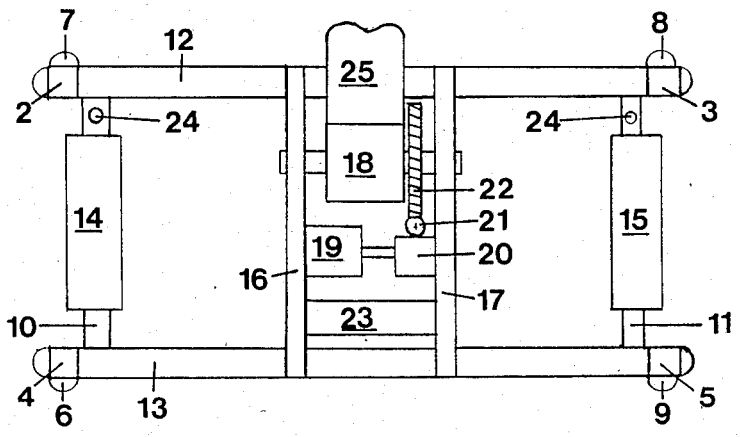
FIG. 2 is a front view of the lifting frame with the cover removed.

Referring now to the drawings, there is shown in FIG. 2 a generally rectangular rigid lift frame comprising a pair of spaced parallel vertical tubular members 10,11 and a pair of spaced parallel horizontal tubular members 12, 13 having lifting points 2, 3, 4, 5 located at each of the four corners. Connector clips 6, 7, 8, 9 are provided at each respective lifting point. Hand grips 14, 15 are provided on respective ones of members 10, 11, and intermediate members 12, 13 there is provided a supplementary frame comprising vertical spaced parallel members 16, 17, having mounted therebetween a winch drum 18 which is driven by an electric motor 19 mounted on one of members 16, 17 and operatively connected via any suitable gearbox 20, mounted on the other of members 16, 17, to a worm gear 21 and hence to a drive gear 22, on drum 18. Motor 19 may be energized by a drycell battery pack 23, which may be conveniently mounted on the frame between members 16, 17. Preferably, but not essentially, battery pack 23 is of the rechargeable Ni-Cad type. The speed and direction of motion of the winch drum 18 may be controlled via thumb control switches 24, located adjacent one or both of hand grips 14, 15, and operatively connected to motor 19 and gear unit 20 in known manner. One end of a strong web or belt 25 is secured to winch drum 18 while the other end thereof is attached to an overhead support (not shown) which may be a single hook, or part of an overhead rail system or the like to permit horizontal movement of the patient from one location to another.

Figure 1:
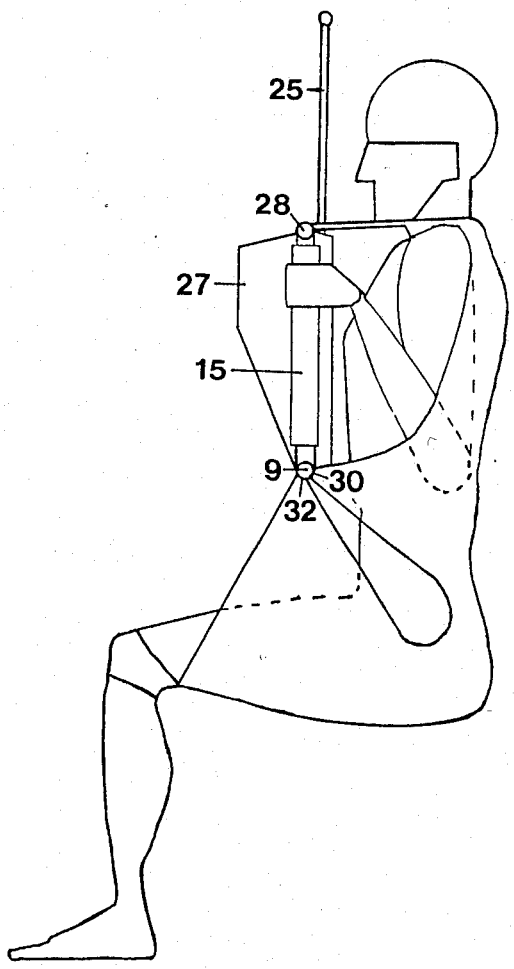
FIG. 1 is a side view of the lifting device of the present invention.
Figure 3:
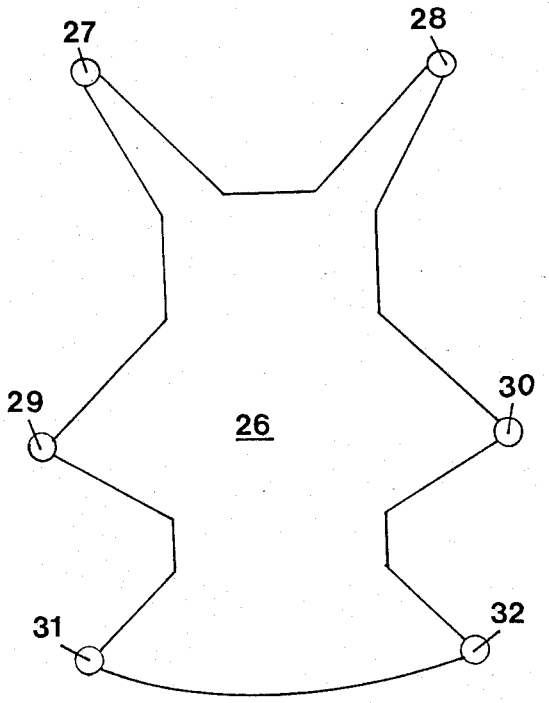
FIG. 3 is a plan view of the lift harness of the present invention.

The above described frame is provided with a canvas or other strong fabric harness 26 preferably, but not essentially, having six lifting eyes 27, 28, 29, 30, 31, 32, as shown in FIG. 3. Eyes 27, 28 are arranged to be connected to connector clips 7, 8 respectively. Eyes 29, 30, are arranged to be connected to lower connector clips 6, 9, respectively thereby providing a back support for the patient. Eyes 31 and 32 are also arranged to be connected to clips 6, 9, thereby forming a seat upon which the patient may be supported comfortably and safely for lifting or lowering as seen more clearly in FIG. 1. It will be appreciated that either the patient or an attendant may operate the controls 24. For convenience and aesthetic appearance, the frame may be provided with a removable cover 27, which protects the winch drum, motor battery pack and gearbox.

Figure 4:
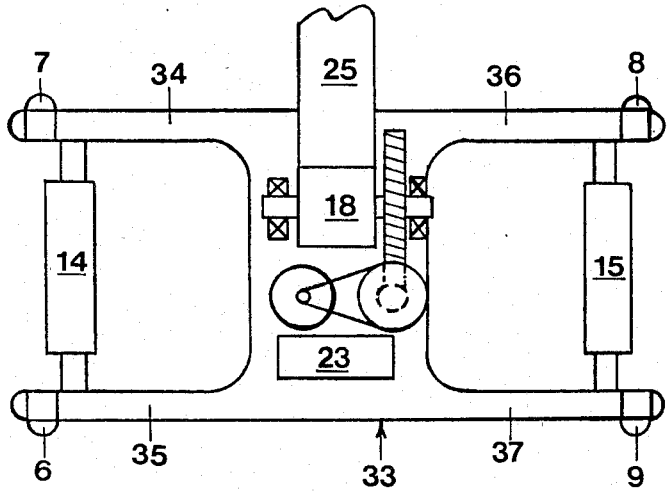
FIG. 4 is a front view of an alternative embodiment of the lifting frame of the present invention.

In an alternative embodiment, illustrated in FIG. 4, the tubular members 10, 11, 12, and 13 making up the rectangular frame are replaced by an H-shaped, rigid, substantially flat planar member 33 having the winch drum 18, motor 19, gearbox 20, and worm gear 21 mounted centrally on one planar surface thereof. Hand grips 14,15 are provided between arms 34,35 and 36,37 respectively. Preferably planar member 33 is fabricated from a plate of steel or aluminum alloy.

I claim:

1. A portable patient controllable motorized patient transfer lift for raising and lowering said patient comprising:

(a) a generally rectangular planar frame having connecting means adjacent each of its four corners and disposable, when in operative position, in a substantially vertical plane adjacent and parallel the patients' chest;

(b) motor means mounted on said frame;

(c) winch drum means mounted on said frame;

(d) gear means mounted on said frame and operatively disposed between said motor means and said winch drum means;

(e) means to activate said motor and gear means, mounted on said frame and accessible to said patient;

(f) a suspension harness having six attachment points arranged to be secured to respective ones of said connecting means so as to provide a seat and back support for said patient; and (g) elongated belt means having one end secured to said winch drum means and the other end thereof adapted for attachment to a lift point located vertically above and spaced from said winch drum so that, upon activation of said motor and gear means, the spacing between said lift point and said winch drum may be selectively varied and thereby raising and lowering said patient between selected positions.

2. A patient transfer lift as claimed in claim 1, including battery means mounted on said frame.

3. A patient transfer lift as claimed in claim 2, wherein said battery means comprises a rechargeable battery pack.

4. A patient transfer lift as claimed in claim 2, including removeable cover means on said frame arranged to cover said motor, gear and battery means.

* * * * *